US005392564A

United States Patent [19]

Fechter et al.

[11] Patent Number: 5,392,564

[45] Date of Patent: Feb. 28, 1995

[54] MODULAR SKYLIGHT COVER UNIT

[75] Inventors: Aaron Fechter, 47 W. Jefferson St., Orlando, Fla. 32801; David M. Bostick, Sanford, Fla.

[73] Assignee: Aaron Fechter, Orlando, Fla.

[21] Appl. No.: 41,450

[22] Filed: Apr. 1, 1993

[51] Int. Cl.[6] ..... E05F 11/00; E04B 7/18

[52] U.S. Cl. ..... 49/360; 49/362; 49/63; 52/200

[58] Field of Search ..... 49/360, 362, 63; 52/200

[56] References Cited

U.S. PATENT DOCUMENTS

| | | | |
|---|---|---|---|
| 928,767 | 7/1909 | Jones | 49/362 |
| 2,657,661 | 11/1953 | Robson | 49/362 |
| 4,039,018 | 8/1977 | De Maria | 49/63 |
| 4,385,470 | 5/1983 | Bryson et al. | 49/63 |
| 4,434,579 | 3/1984 | Murphy | 49/63 |
| 4,665,964 | 5/1987 | Zommers | 160/84 |
| 4,726,156 | 2/1988 | Cousino | 49/63 |
| 4,762,160 | 8/1988 | Bechtold et al. | 160/98 |
| 5,088,543 | 2/1992 | Bilbrey | 160/310 |
| 5,176,582 | 1/1993 | Chang et al. | 49/360 |
| 5,189,836 | 3/1993 | Alder et al. | 49/360 |

*Primary Examiner*—Michael J. Milano
*Attorney, Agent, or Firm*—Warren L. Franz

[57] ABSTRACT

A skylight cover for relatively blocking transmission of light through a lens opening of a skylight structure takes the form of a modular unit (10, 110), configured to fit between standard ceiling joists (16, 17). The unit includes a movable panel (30, 130), panel tracks (33, 133), and a panel drive mechanism (40, 45, 48; 161, 162,164), all housed in a common, readily installable and serviceable framework (12, 112). In one embodiment (10), the drive mechanism is a cable air cylinder (40) having end brackets (48) attached by a slide-in mounting assembly (58) to a frame member 39, and having a U-shaped cable bracket (48) deposited over posts (51) on the panel (30). In another embodiment (110), the drive mechanism is a motor (161) having an output gear (162) meshed with a gear track (164) on the panel (130).

15 Claims, 3 Drawing Sheets

MODULAR SKYLIGHT COVER UNIT

This invention relates, in general, to a cover for a skylight; and, in particular, to a skylight cover having a movable panel, panel tracks and a panel drive mechanism, all housed in a common framework, and constructed as a modular unit configured to fit between standard ceiling joists.

BACKGROUND OF THE INVENTION

Skylight structures of various types are known in residential and commercial construction. Such structures have transparent or translucent glass and/or plastic lenses which admit outside light through an opening in a roof or ceiling into an underlying space. The skylight may provide useful illumination, or merely serve a decorative or aesthetic purpose.

There are times when it is desirable to be able to temporarily block the transmission of light through a skylight. This may occur, for example, in tropical climes, when it is sought to cover the skylight in order to avoid the adverse effects of intense heat or glare radiated through the skylight when the sun is directly overhead, or when somebody who works nights is trying to sleep in an underlying bedroom. This may also occur at night, to prevent outsiders from being able to see through the skylight into the privacy of an artificially illuminated area below.

Conventional skylight covers take the form of flexible curtains or mats that are drawn, typically by edge-connected cords or webbing, across the skylight lenses or openings. The flexible nature of such covers makes them difficult to clean and often leads to snagging and other problems associated with their usual drawstring operation. The mechanisms used to drive such covers constitute separate elements independently mounted on the skylight or adjacent structures and, so that they are hidden from view, are frequently located in places that are difficult to access for servicing. Moreover, the flexible covers serve little, if any, back up to shield against debris should the skylight break because of a violent storm, or otherwise. Examples of prior art skylight shades are given in U.S. Pat. Nos. 4,665,964; 4,762,160 and 5,088,543.

SUMMARY OF THE INVENTION

It is an object of the present invention to provide an improved skylight cover which is easy to install and service, and which overcomes the described deficiencies of conventional covers.

The skylight cover of the invention takes the form of a modular unit, configured to fit between standard ceiling joists, and which includes a movable panel, panel tracks, and a panel drive mechanism, all housed in a common, readily installable and serviceable framework.

In a preferred embodiment, described in further detail below, the drive mechanism comprises an air cylinder mounted in such a way that it can be conveniently installed and removed through a simple service access panel, without otherwise having to disturb the unit.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DETAILED DESCRIPTION OF PREFERRED EMBODIMENTS

Figure 1:
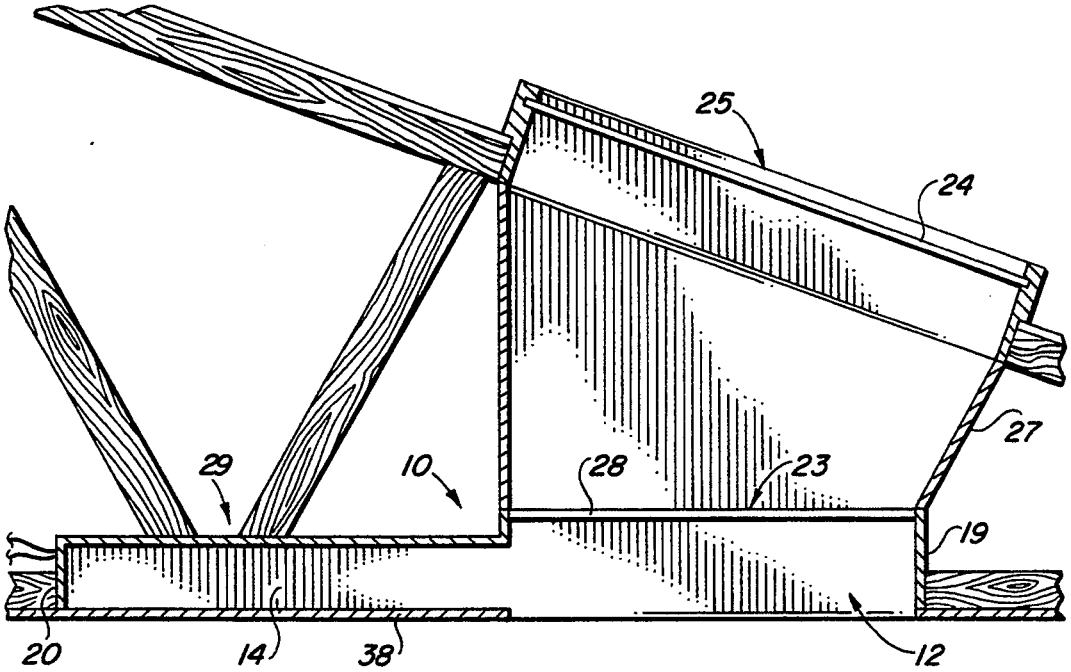
FIG. 1 is a side view, in cross-section, showing a modular skylight cover unit in accordance with the invention, mounted for selectively blocking light transmission through the lens opening of a conventional skylight structure.
Figure 2:
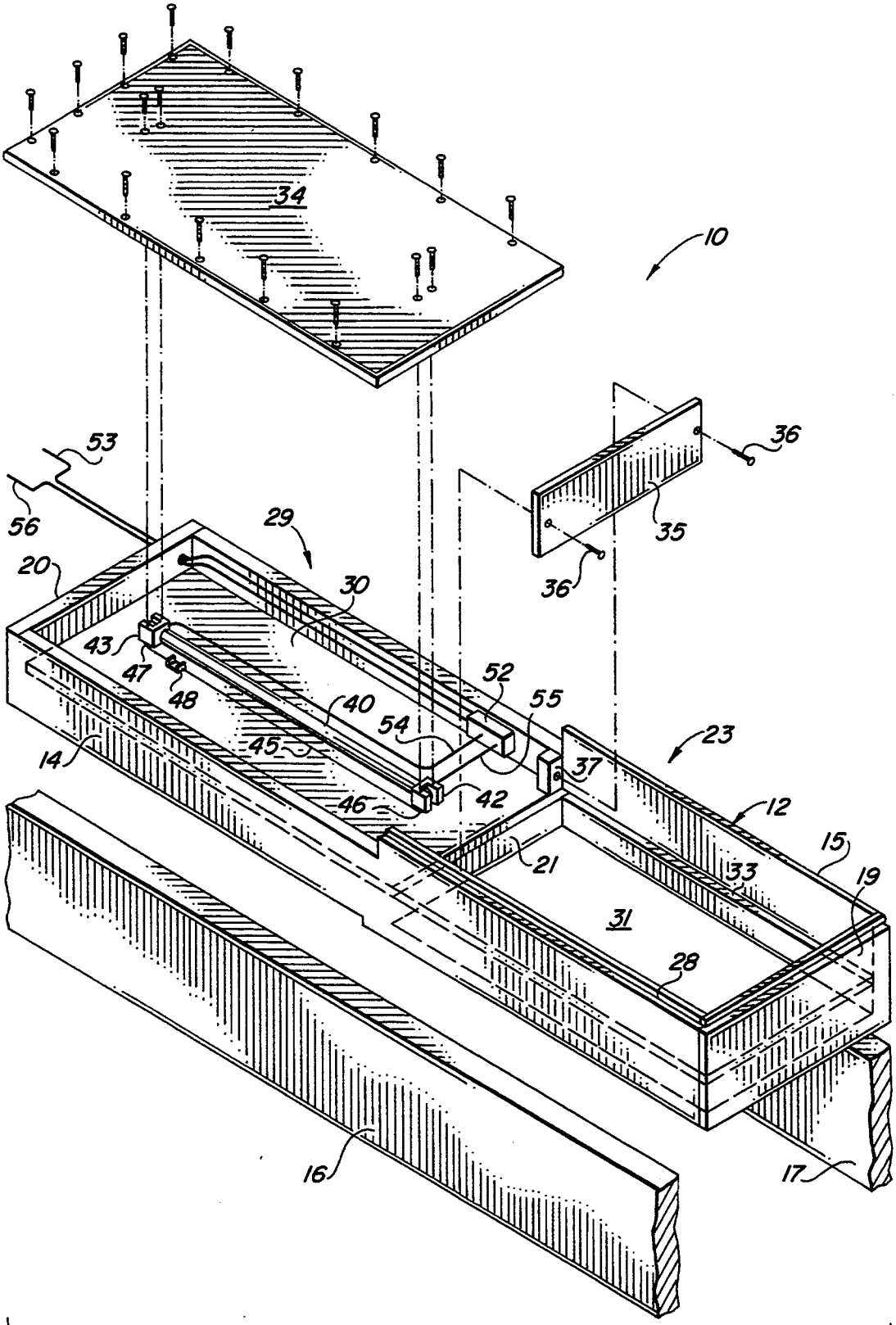
FIG. 2 is an exploded perspective view of the skylight cover unit of FIG. 1, shown in the cover "open" position.

As shown in FIGS. 1 and 2, an illustrative embodiment 10 of a modular skylight cover unit in accordance with the invention includes a generally rectangular framework housing 12 having parallel spaced, longitudinally extending left and right side frame members 14, 15 secured in the gap between standard spacing of corresponding left and right longitudinally extending ceiling joists 16, 17. Such joists are typically separated by 24-inch spacing, center-to-center, and framework 12 is dimensioned to bring opposing, external vertical surfaces of frame members 14, 15 into abutment with respective facing, internal vertical surfaces of joists 16, 17. Side frame members 14, 15 are joined at their ends by front and rear laterally extending end frame members 19, 20, and joined in the middle by a laterally extending central frame member 21. The front portion 23 of the framework 12, formed between the frame members 19, 21, acts as the light transmitting window of unit 10 and is disposed either directly below the lens 24 of a skylight 25, or at the lower end of a light tunnel 27 interposed to frame the region between skylight 25 and unit 10. For the implementation illustrated in FIG. 1, the frame members 14, 15, 19 have stepped widths to provide an offset lip 28 to match drywall or similar trim joined to the window portion 23.

The rear portion 29, formed between frame members 20 and 21, acts to house the mechanism for driving a rigid planar rectangular panel 30 between a retracted, cover "open" storage position housed within portion 29 and an advanced, cover "closed" position covering the rectangular opening 31 in portion 23 through which light from skylight 25 can otherwise pass. A recessed track 33 formed on inwardly facing surfaces of frame members 14, 15 and 19 serves to guide panel 30 throughout its movement. The heights (vertical dimensions) of frame member 19 and parts of frame members 14, 15 in portion 23 are suitably chosen to match the corresponding heights of joists 16, 17, so that an observer looking from below through opening 31, up toward skylight 25, will see a smooth, pleasing contour. Frame member 21 has a height to match the elevation of track 33 above the lower edges of frame members 14, 15, 19. This enables a horizontal top surface of frame member 21 to support panel 30 in both its "open" and "closed" positions, and to guide panel 30 during its movement between those positions. Track 33 is advantageously trimmed with angled aluminum pieces and the top of frame member 21 may be covered with felt so as not to mar the underside of panel 30. A laterally extending access frame member 35 is removably mounted by means of fasteners 36 to blocks 37, to fill the separation between frame members 14, 16, above frame member 21. The lower edge of panel 35 terminates above the top of frame member 21 by an amount equal to the height of track 33.

The lower edges of frame members 14, 15 are stepped up from portion 23 to portion 29 so that a sheet of drywall or other finishing material 38 placed under the portion 29 will be even with the lower edge at portion 23. The height dimensions of frame members 14, 15, 20 in portion 29 are unimportant, except that they should be sufficient to provide the rear portions of track 33 and to be able to adequately receive the "open" panel 30 and its corresponding drive mechanism. The top of portion 29 is closed off by a horizontal rectangular frame member 39 that is fastened to upper edges of frame member 20 and the rear parts of frame members 14, 15.

Figure 3:
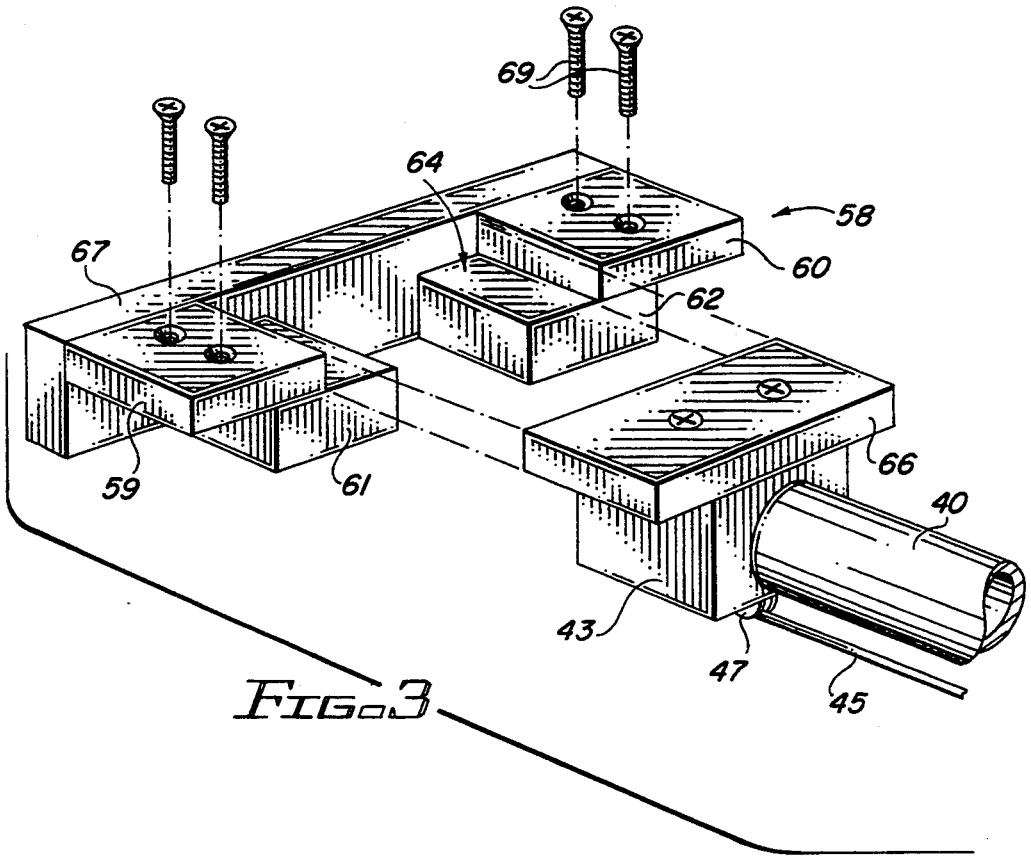
FIGS. 3 and 4 fragmentary views showing details of assembly of the drive mechanism elements of the unit.
Figures 4, 5:
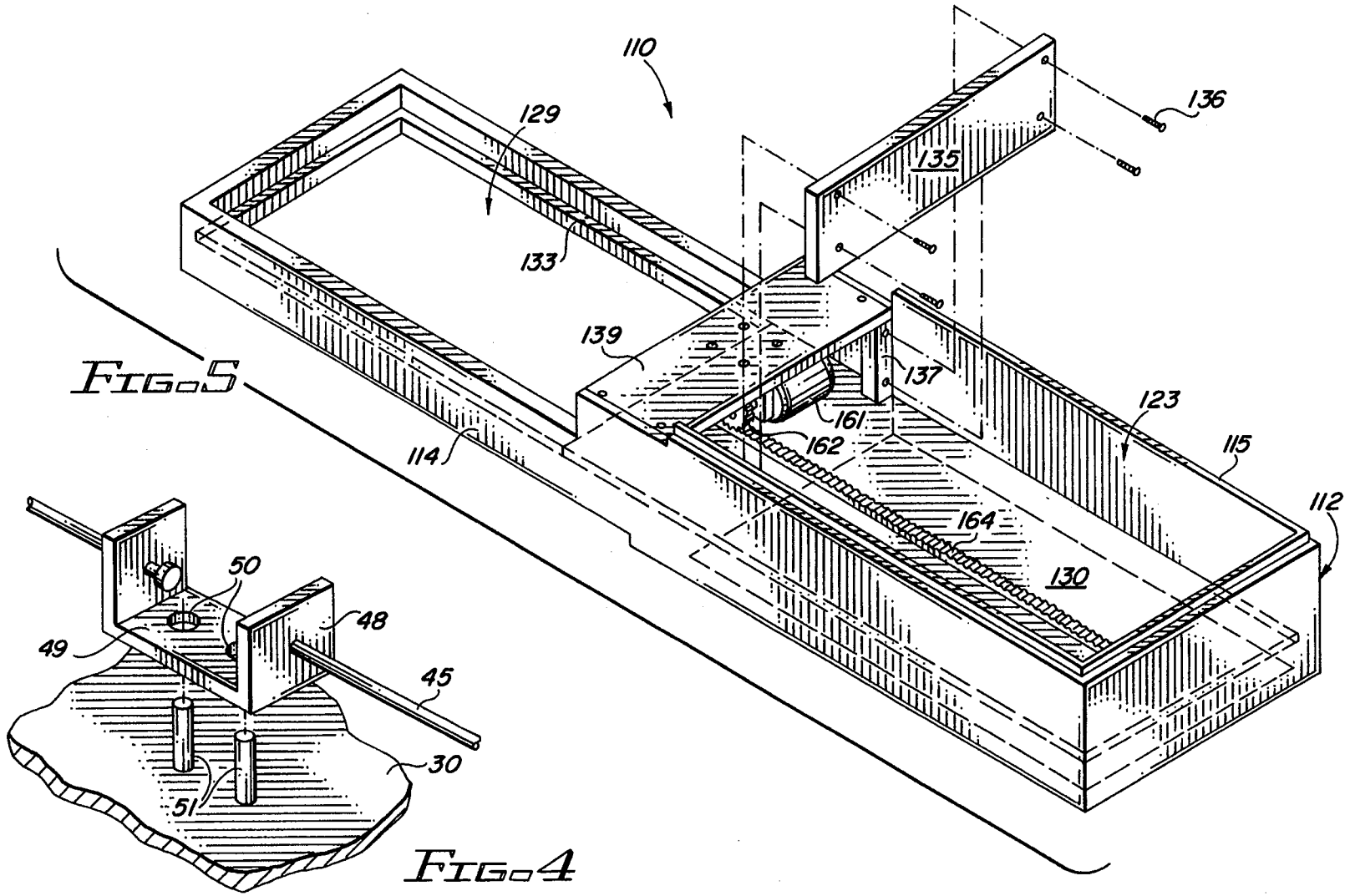
FIG. 5 is an exploded perspective view of a modified form of the same unit, shown in the cover "closed" position.

One form of drive mechanism for moving panel 30 between its "open" and "closed" positions is shown in FIGS. 2–4, and comprises a conventional cable air cylinder 40 attached at U-shaped brackets 42, 43 to run longitudinally, centrally below frame member 39. Cylinder 40 includes means for driving a cable 45 bidirectionally about pulleys 46, 47 respectively disposed between opposing legs of the brackets 42, 43. A U-shaped, cable attachment bracket 48 (see FIG. 4) includes a horizontal intermediate portion 49 having apertures 50 through which upwardly-directed posts 51 on the upper surface of panel 30 can be brought. Operation of cylinder 40 is under control of a solenoid valve 52, attached at an out-of-the-way position elsewhere within the interior of portion 29 above panel 30, which controls the flow of air from a supply line 53 to one or the other of air lines 54, 55 that connect to the respective ends of cylinder 40. Electrical power for operation of solenoid 52 is delivered from a remote location by means of an electrical conductor 56.

The cylinder 40 is shown attached directly to frame member 39 in FIG. 2. However, such attachment may make the drive mechanism difficult to access for servicing, when unit 10 is installed in some locations. Accordingly, making the connection as shown in FIG. 3 will permit easier servicing. As shown in FIG. 3, each connection between a bracket 42, 43 and the frame member 39 is made using a mounting assembly 58. The illustrated assembly 58 is for mounting the rear cylinder bracket 43. Assembly 58 has two upper blocks 59, 60 laterally spaced from each other, and two lower blocks 61, 62 fixed to the respective undersides of the blocks 59, 60. The blocks 61, 62 are also laterally spaced but not by as much as the blocks 59, 60. This difference in spacing leaves a centrally broken horizontal platform 64 onto which opposite, laterally extending surfaces of the underside of a block 66 attached to the top of bracket 43, can be received. The rear element 58 is backed up by a stop member 67 which prevents further rearward movement of the member 66. A similar assembly 58 is located to receive a block 66 attached to the front bracket 42, but without the stop member 67. The frame member 35 serves the function of stop member 67 for the front assembly 58. Fasteners 69 thread through the member 39 into the blocks 59, 60. With this arrangement, the air cylinder 40 assembly can be inserted and removed, without having to access the enclosed rear portion 30, except through the service port left after access frame member 35 has been removed. Solenoid 52 should be positioned to make it accessible and removable through the same service port, as well.

During insertion, the rear bracket 66 is slid over the platform 64 of the rear element 58 until it contacts the stop 67; and the front bracket 66 is simultaneously slid over the corresponding platform 64 of the front element 58. The attachment bracket 48 is then maneuvered so that the holes 50 fit over the pins 51 and the access frame member 35 is closed to provide a stop against forward shifting of the front bracket 66.

In response to user operation of a wall switch (not shown), solenoid 52 is activated to provide air to the lines 54, 55 for driving the cylinder to move cable 45 so that bracket 48 moves toward the front portion 23. This drives posts 51 and, thus, panel 30 along the guide track 33 to cover the opening 31 in front portion 23, thereby blocking light from lens 24 of skylight 25. When it is desired to reopen the skylight cover, the solenoid 52 is again activated by the switch to apply air to the line 54, 55 for driving bracket 48 in the opposite direction, thereby moving the panel from its skylight "closed" back to its skylight "open" position.

FIG. 5 shows an alternate embodiment 110 of the invention, employing an electric motor drive mechanism. Unit 110 has a framework 112 similar to framework 12 of unit 10, discussed above; however, in place of air cylinder 40, unit 110 has a bidirectional electric motor 161 mounted below a support member 139 that extends laterally between intermediate parts of side frame members 114, 115, at the front of rear portion 129. The teeth of a gear 162 mounted on an output shaft of motor 161 mesh with complementary teeth of a gear track 164, running longitudinally centrally along the top surface of a panel 130 which is mounted to move between "open" and "closed" positions on track 133. When gear 162 is rotated in one direction, gear 162 drives gear 164 to move panel 130 in one direction; and when gear 162 is rotated in the opposite direction, gear 162 drives gear 164 to move panel 130 in the opposite direction. As with unit 10, unit 110 has an access member 135 that is secured by means of fasteners 136 to blocks 137, to conceal the drive mechanism from an observer looking up toward the skylight through the front portion 123.

Those skilled in the art to which the invention relates will appreciate that other substitutions and modifications can be made to the described embodiment without departing from the spirit and scope of the invention as described by the claims below.

What is claimed is:

1. A modular skylight cover unit for selectively blocking the transmission of light through a lens opening of a skylight structure, said cover unit comprising:

a rectangular framework including parallel spaced, longitudinally extending left and right side frame members having inwardly facing surfaces and ends; parallel spaced, laterally extending front and rear end frame members joining respective ones of said ends of said side frame members; and a laterally extending central frame member joining parts of said side frame members intermediate said ends; said central frame member having a top surface and dividing said framework into front and rear portions, and said front portion defining a rectangular opening;

a longitudinal track formed on said inwardly facing surfaces of said side frame members;

a rigid rectangular panel having upper and lower surfaces and left and right edges, and being mounted on said framework with said left and right edges supported on said track;

a drive mechanism, mounted on said rear portion of said framework and connecting one surface of said panel, for driving said panel on said track between a retracted cover "open" position wherein said panel is housed in said rear portion, and an advanced cover "closed" position wherein said panel covers said opening; said panel being supported by said central frame member top surface in both said cover "closed" and cover "open" positions; and means concealing said drive mechanism from view of an observer looking through said opening from below said framework, when said panel is in said cover "open" position.

2. The unit of claim 1, wherein said means concealing said drive mechanism comprises a laterally extending access frame member, removably mounted between said side frame members above said track at said central frame member.

3. The unit of claim 2, wherein said drive mechanism comprises a cable, an air cylinder including means for driving said cable bidirectionally, means attaching said air cylinder to said rear portion of said framework, and means connecting said cable to said one surface of said panel.

4. The unit of claim 3, wherein said means attaching said air cylinder to said rear portion comprises a mounting assembly attached to said rear portion, and means attaching said air cylinder to said mounting assembly without access to said rear portion except through said removably mounted access frame member.

5. The unit of claim 4, wherein said means connecting said cable comprises upwardly-directed posts on said panel, and an attachment bracket on said cable having apertures through which said upwardly-directed posts can be brought.

6. The unit of claim 2, wherein said drive mechanism comprises a bidirectional electric motor mounted on said framework, a gear mounted on said motor, and a gear track meshing with said gear and running longitudinally on said one surface of said panel.

7. In combination with a ceiling having a skylight structure, including a lens opening, and left and right ceiling joists separated by a gap; modular skylight cover unit for selectively blocking the transmission of light through a lens opening of a skylight structure, said cover unit comprising:

a rectangular framework including parallel spaced, longitudinally extending left and right side frame members having inwardly and outwardly facing surfaces and ends; parallel spaced, laterally extending front and rear end frame members respectively attached in said gap to said joists and joining respective ones of said ends of said side frame members; and a laterally extending central frame member joining parts of said side frame members intermediate said ends; said central frame member dividing said framework into front and rear portions, and said front portion defining an opening disposed below said lens opening;

a longitudinal track formed on said inwardly facing surfaces of said side frame members;

a rigid rectangular panel having upper and lower surfaces and left and right edges, and being mounted on said framework with said left and right edges supported on said track;

a drive mechanism, mounted on said rear portion of said framework and connecting said upper surface of said panel, for driving said panel on said track between a retracted cover "open" position wherein said panel is housed in said rear portion, and an advanced cover "closed" position wherein said panel covers said front portion opening; and means concealing said drive mechanism from view of an observer looking through said front portion opening toward said lens opening, from below said framework, when said panel is in said cover "open" position.

8. The combination of claim 7, wherein said central frame member has a top surface; and said panel is supported by said top surface in both said cover "closed" and cover "open" positions.

9. The combination of claim 8, wherein said means concealing said drive mechanism comprises a laterally extending access frame member, removably mounted between said side frame members above said track at said central frame member.

10. The combination of claim 7, wherein said drive mechanism comprises a cable, an air cylinder including means for driving said cable bidirectionally, means attaching said air cylinder to said rear portion of said framework, and means connecting said cable to said upper surface of said panel.

11. The combination of claim 10, wherein said means attaching said air cylinder to said rear portion comprises a mounting assembly attached to said rear portion, and means attaching said air cylinder to said mounting assembly without access to said rear portion except through said removably mounted access frame member.

12. The combination of claim 11, wherein said means connecting said cable comprises upwardly-directed posts on said panel, and an attachment bracket on said cable having apertures through which said upwardly-directed posts can be brought.

13. The combination of claim 9, wherein said drive mechanism comprises a bidirectional electric motor mounted on said framework, a gear mounted on said motor, and a gear track meshing with said gear and running longitudinally on said one surface of said panel.

14. The combination of claim 7, wherein said joists have inwardly facing surfaces, and said outwardly facing surfaces of said side frame members are respectively attached to said inwardly facing surfaces of said joists.

15. A modular skylight cover unit for selectively blocking the transmission of light through a lens opening of a skylight structure, said cover unit comprising:

a rectangular framework including parallel spaced, longitudinally extending left and right side frame members having inwardly facing surfaces and ends; parallel spaced, laterally extending front and rear end frame members joining respective ones of said ends of said side frame members; and a laterally extending central frame member joining parts of said side frame members intermediate said ends; said central frame member having a top surface and dividing said framework into front and rear portions, and said front portion defining a rectangular opening;

a longitudinal track formed on said inwardly facing surfaces of said side frame members;

a rigid rectangular panel having upper and lower surfaces and left and right edges, and being mounted on said framework with said left and right edges supported on said track and said lower surface supported on said central frame member top surface;

a drive mechanism, including a drive member mounted on said rear portion of said framework and including a connector driven by said drive member and connecting one surface of said panel, for driving said panel on said track and top surface between a retracted cover "open" position wherein said panel is housed in said rear portion, and an advanced cover "closed" position wherein said panel covers said opening; and an access frame member, removably mounted between said side frame members above said track at said central frame member, concealing said drive mechanism from view of an observer looking through said opening from below said framework, when said panel is in said cover "open" position.

* * * * *